United States Patent [19]

McClean

[11] Patent Number: 4,685,479

[45] Date of Patent: Aug. 11, 1987

[54] HEATING HAIR ROLLERS

[75] Inventor: John W. McClean, Sydney N.S.W., Australia

[73] Assignee: Breville R & D Pty. Ltd., Pyrmont, Australia

[21] Appl. No.: 751,493

[22] Filed: Jul. 3, 1985

[30] Foreign Application Priority Data

Jul. 13, 1984 [AU] Australia ..... PG5997
Nov. 28, 1984 [AU] Australia ..... PG8327

[51] Int. Cl.[4] ..... A45D 2/36

[52] U.S. Cl. ..... 132/36 R; 132/9; 132/33 R; 219/222; 219/242; 219/273; 34/243 R

[58] Field of Search ..... 132/36 R, 36 A, 36 AA, 132/9, 36 C, 36 D, 36.2 R, 40, 11 R, 31 R, 33 R, 33 F, 34 C, 36 R, 37 R, 38 R; 219/222, 220–226, 242, 488, 521, 273; 34/104, 243 R

[56] References Cited

U.S. PATENT DOCUMENTS

| | | | |
|---|---|---|---|
| 1,260,267 | 3/1918 | Jacobs et al. | 132/36 AA |
| 1,852,933 | 4/1932 | Maier | 132/36 C |
| 1,938,188 | 12/1933 | McEwen et al. | 132/36 D |
| 2,217,729 | 10/1940 | Chancey | 132/36 R |
| 3,319,350 | 5/1967 | Hlubik | 132/36.2 R |
| 3,454,318 | 7/1969 | Kemp et al. | 219/242 |
| 3,584,632 | 6/1971 | Weidner | 132/9 |
| 3,990,460 | 11/1976 | Shalvoy | 132/9 |
| 4,230,279 | 10/1980 | Forsberg | 34/243 R |
| 4,287,673 | 9/1981 | Wolter | 34/243 R |
| 4,293,760 | 10/1981 | Smal | 132/9 |
| 4,298,787 | 11/1981 | Barradas | 132/9 |
| 4,516,011 | 5/1985 | Jeffress et al. | 132/9 |
| 4,523,080 | 6/1985 | Bolton | 132/9 |

FOREIGN PATENT DOCUMENTS

| | | | |
|---|---|---|---|
| 2918205 | 11/1980 | Fed. Rep. of Germany | 219/222 |
| 736290 | 11/1932 | France | 132/36 R |
| 812112 | 4/1937 | France | 132/36 C |
| 1185689 | 3/1970 | United Kingdom | 219/222 |

*Primary Examiner*—Gene Mancene
*Assistant Examiner*—J. Hakomaki
*Attorney, Agent, or Firm*—Holman & Stern

[57] ABSTRACT

A device for heating hair curling rollers consisting of an attachment for a hair dryer of the small portable type which is frictionally attached to the barrel of the hair dryer so that heated air from the dryer passes through the attachment. The attachment is arranged to support a number of hair curling rollers of a conventional type and to direct air from the hair dryer into and around the rollers to heat them to a working temperature. The usual heat indicating spot provided on each roller may be applied to the exterior of the attachment. As an adjunct to the attachment an adaptor is provided to enable the attachment to be attached to hair dryers having barrels of different external diameters. A fan is preferably included in the attachment to assist in even distribution of heated air over the hair curling rollers.

3 Claims, 4 Drawing Figures

HEATING HAIR ROLLERS

The present invention relates to a means for heating hair curling rollers.

Hair curling rollers consist of a hollow cylinder open at one end and closed at the other. The wall of the cylinder consists usually of an internal liner of metal usually aluminium and an external covering of plastic material which is formed with a flock coating or surface irregularities to facilitate the winding of a lock of hair onto the roller. To use a hair curling roller it is necessary that it be heated to an appropriate temperature and this is done by means of an electrically heated fixture having on it a plurality of upstanding posts, the diameter of which is such that each post will fit closely within the interior of the hair curling roller. Heat is passed from the fixture to the metal lining of the roller. In the closed end of the roller a temperature indicator is usually provided in the form of a red spot which turns black when the appropriate temperature is reached. Thus, to use the rollers it is necessary to have the heating fixture which, being mains operated is of a not insignificant size and weight such that it is inconvenient to take when travelling.

The present invention takes advantage of the fact that it is quite usual to take a small portable hair dryer when travelling and use is made of this circumstance by the invention to provide a means for heating hair rollers without the usual heating fixture, utilising instead a simple and light attachment adapted to be used in conjunction with an electric hair dryer.

The present invention consists in means for heating hair curling rollers comprising an attachment for an electric hair dryer, the attachment comprising an air entry section adapted to be engaged about the air outlet of an electric hair dryer and an air outlet section adapted to receive and support a plurality of hair curler rollers and means to direct heated air from the hair dryer and cause it to enter the interior of each roller and pass around the roller thereby heating the roller. Holes may be formed in the ends of each roller to allow heated air to pass through it. The provision of such holes has however been found inessential.

In order that the nature of the invention may be better understood a preferred form thereof is hereinafter described by way of example with reference to the accompanying drawings in which.

Figure 1:
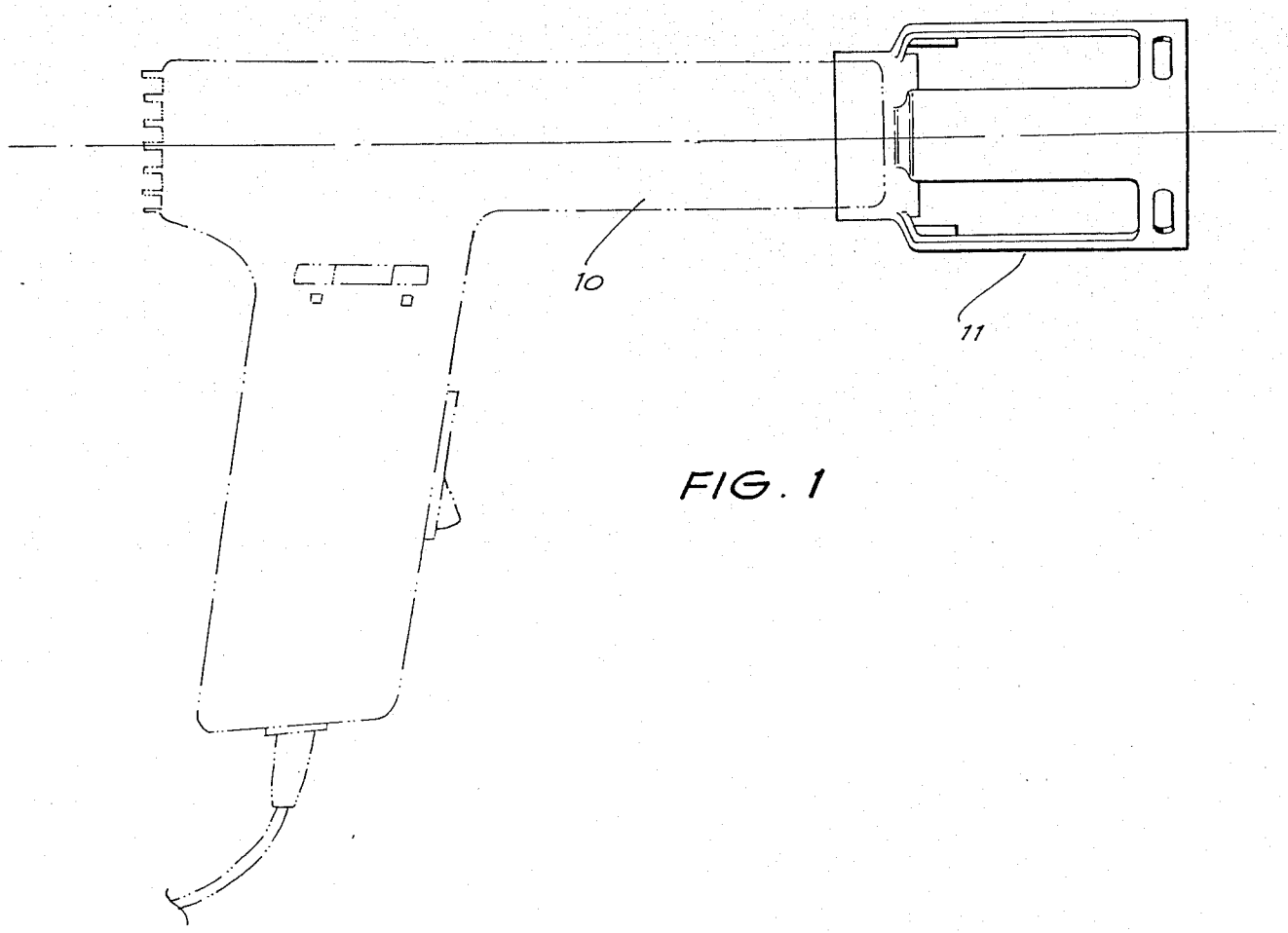
FIG. 1 is a view in elevation of an electric hair dryer with an attachment according to the invention affixed to it.
Figure 2:
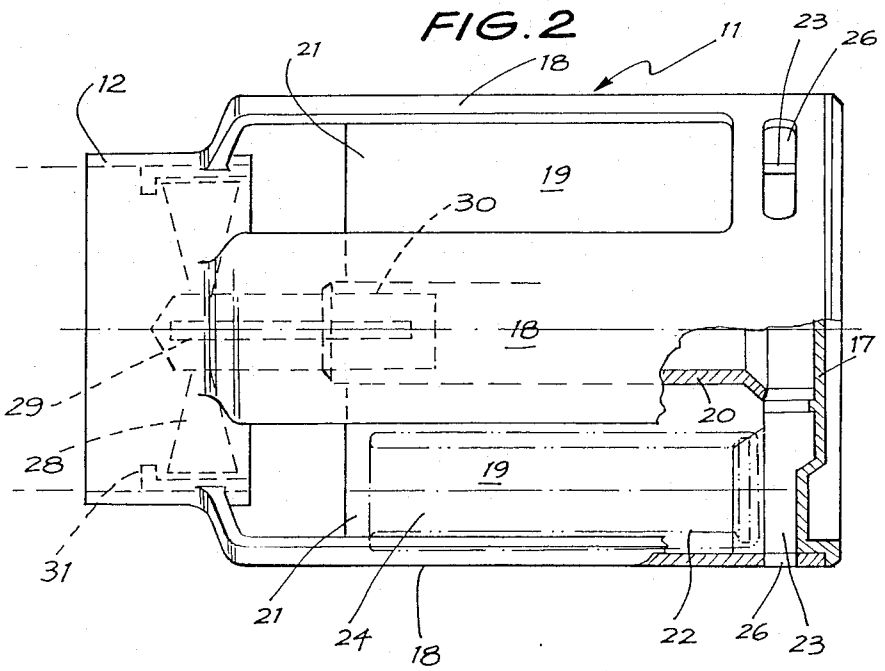
FIG. 2 is a part sectional elevation of the attachment.
Figure 4:
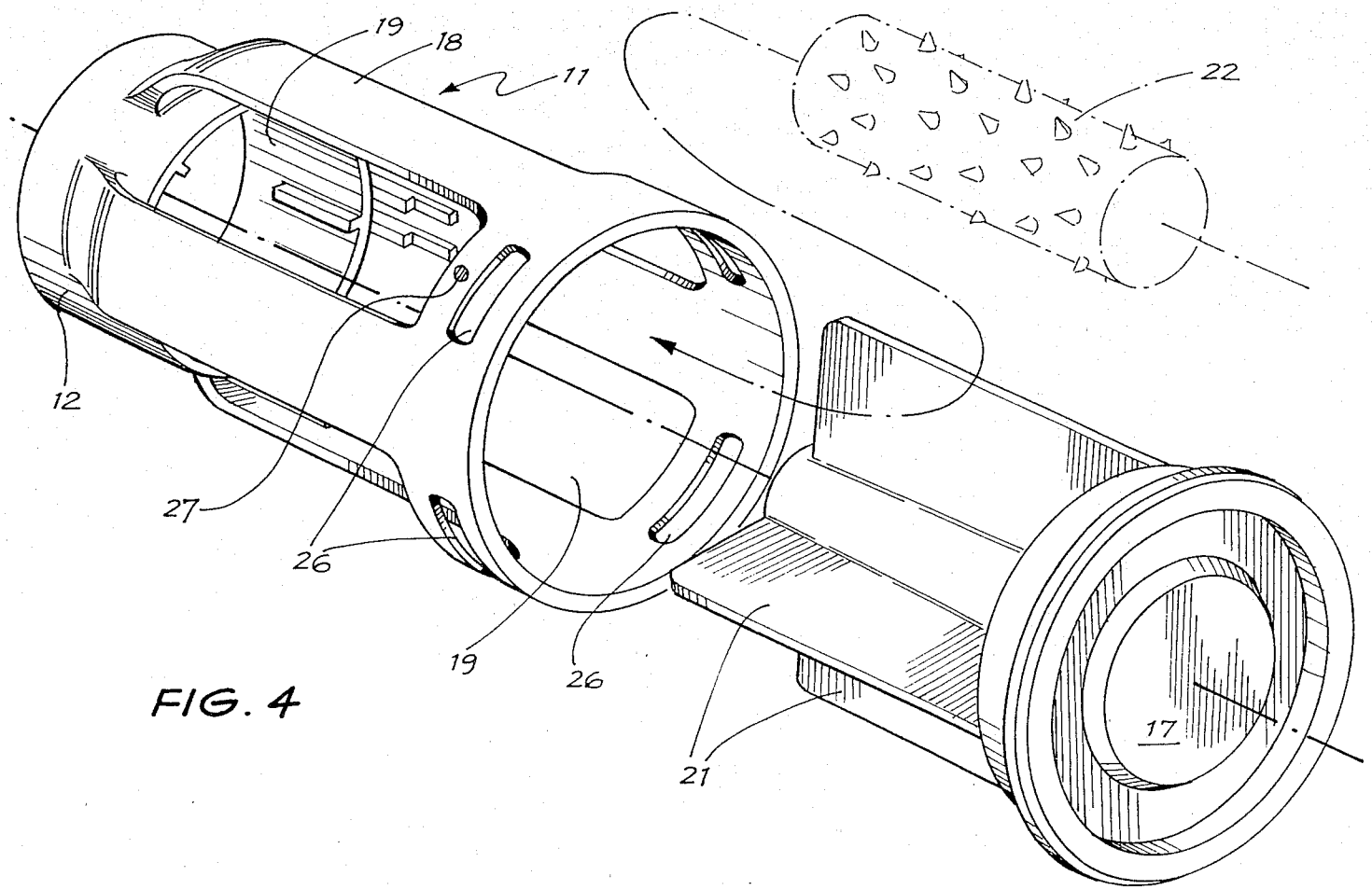
FIG. 4 is an exploded view of the attachment of FIG. 2 illustrating the manner in which the parts thereof are assembled.

In FIG. 1 an electric hair dryer of conventional construction is shown in chain lines at 10 having frictionally attached at the air output end of its barrel an attachment indicated generally at 11 details of which are shown in FIGS. 2 and 4.

Figure 3:
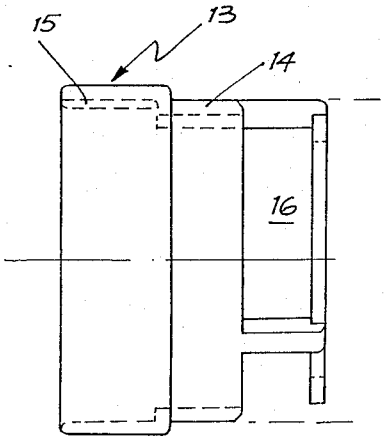
FIG. 3 is an elevation of an adapter by means of which the attachment is made suitable for use with hair dryers of different dimensions.

The attachment 11 is moulded from any suitable plastic material and consists of an attachment collar 12 the internal diameter of which is such as to enable it to be frictionally engaged over the barrel of a hair dryer such as that depicted in FIG. 1. However, to take account of the fact that hair dryers can come in a number of different sizes an adapter ring 13 shown in FIG. 3 is provided. Where required this is frictionally fitted within the collar 12 and has two portions of different internal diameter, a first portion 14 of smaller internal diameter and a second portion 15 of larger internal diameter. The attachment is constructed so that when fitted in the adapter ring 13, heated air from the electric hair dryer can pass through apertures 16 into the attachment 11. The adapter ring 13 is required only when the internal diameter of the attachment collar 12 does not match the diameter of the barrel of the hair dryer.

The attachment 11 has a bottom 17 which is connected to the collar 12 by the four longitudinally extending wall portions 18 which are separated by openings 19. Projecting from the centre of the floor 17 is a column 20 and four radially extending dividing walls 21 which divide the interior of the attachment into the four separate compartments, each accessible through one of the openings 19. The bottom 17 and dividing walls 21 are moulded integrally as shown in FIG. 4 and one assembled with the remainder of the attachment and fixed permanently in position.

In use the attachment is affixed to a hand electric hair dryers in the manner illustrated in FIG. 1 and a hair roller such as that shown in FIG. 2 and FIG. 4 at 22 is inserted into each of the apertures 19, the rollers being supported on radially extending ribs 23. Heated air from the electric hair dryer passes into the attachment and down the bore 24 of each hair roller 22 and flows around the rollers leaving the attachment through lateral apertures 26.

A temperature indicator spot 27 such as is normally placed on the end of such roller is placed on the side of the attachment. Change of colour of the spot indicates that the rollers have reached an appropriate temperature for use.

It has been found that the temperature of air delivered by the hair dryer varies from place to place at the output of a dryer. In order to ensure that all rollers are uniformly heated a small fan 28 is provided. This fan rotates on the pin 29 supported in a nylon bearing 30. In order to control the flow of heated air to the fan 28 a ring 31 is provided in the collar 12. This also performs the function of preventing the fan from falling out of the attachment.

For a person who proposes to travel with a hair dryer particularly a compact travelling hair dryer the invention avoids the necessity for a special fitting to be taken additionally for the purpose of heating the hair curling rollers.

The embodiment of the invention described above is given by way of example only as constituting a preferred form of the invention within the broad scope thereof as defined in the succeeding claims. The shape of the attachment may be varied in a variety of ways provided that it effectively directs heated air into and around a plurality of hair curling rollers.

I claim:

1. A heater for hair curling rollers comprising an attachment for an electric hair dryer, the attachment comprising an air entry section adapted to be engaged about the air outlet of an electric hair dryer and an air outlet section adapted to receive and support a plurality of hair curler rollers and means to direct heated air from the hair dryer and cause it to enter the interior of each roller and pass around the roller thereby heating the roller wherein there is provided in the air entry section a fan arranged to distribute heated air from the hair dryer evenly to the hair rollers, wherein the air entry section consists of a ring for engaging the end of a barrel of an electric hair dryer and wherein the outlet section comprises a bottom for supporting a plurality of hair rollers in an axially parallel relationship.

2. A means for heating hair curling rollers as claimed in claim 1 wherein the bottom is connected to the entry section by longitudinally extending wall portions separated by openings, radially extending internal partitions providing accommodation for the said plurality of hair rollers in separate compartments each recessible through one of said openings, a lateral air exit aperture being provided from each compartment.

3. A means as claimed in claim 2 wherein the fan is located between said ring and said outlet section and the lateral exit apertures are located adjacent the bottom, the attachment being configured for heated air to flow unidirectionally from the hair dryer through the fan and rollers in an axial direction and then to flow outwardly of the attachments through the exit apertures.

* * * * *